US010215395B2

(12) United States Patent
Hodgson

(10) Patent No.: US 10,215,395 B2
(45) Date of Patent: Feb. 26, 2019

(54) LUMINAIRES

(71) Applicant: AC/DC LED Limited, Lancashire (GB)

(72) Inventor: Daniel Peter Hodgson, Lancashire (GB)

(73) Assignee: AC/DC LED LIMITED (GB)

( * ) Notice: Subject to any disclaimer, the term of this patent is extended or adjusted under 35 U.S.C. 154(b) by 204 days.

(21) Appl. No.: 15/124,889

(22) PCT Filed: Mar. 16, 2015

(86) PCT No.: PCT/GB2015/050754
§ 371 (c)(1),
(2) Date: Sep. 9, 2016

(87) PCT Pub. No.: WO2015/136313
PCT Pub. Date: Sep. 17, 2015

(65) Prior Publication Data

US 2017/0016611 A1 Jan. 19, 2017

(30) Foreign Application Priority Data

Mar. 14, 2014 (GB) ..... 1404632.0

(51) Int. Cl.
*F21V 31/00* (2006.01)
*F21S 8/00* (2006.01)
(Continued)

(52) U.S. Cl.
CPC ..... *F21V 31/005* (2013.01); *F21S 8/033* (2013.01); *F21S 8/043* (2013.01); *F21V 17/14* (2013.01);
(Continued)

(58) Field of Classification Search
CPC .. F21S 8/032; F21S 8/033; F21S 8/036; F21S 8/043; F21V 17/14; F21V 21/02;
(Continued)

(56) References Cited

U.S. PATENT DOCUMENTS 7,137,721 B1 * 11/2006 Rao ..... F21V 21/0824 362/371
7,360,917 B2 * 4/2008 Chien ..... F21V 21/0824 362/153.1

FOREIGN PATENT DOCUMENTS

| | | |
|---|---|---|
| CN | 201259153 | 6/2009 |
| EP | 2453169 | 5/2012 |
| WO | 2013029409 | 3/2013 |

OTHER PUBLICATIONS

Internet address www.acdclighting.co.uk/led/fusion/#06tab, AC DC Lighting Fusion, printed Aug. 16, 2016.
(Continued)

*Primary Examiner* — Stephen F Husar
(74) *Attorney, Agent, or Firm* — Andrus Intellectual Property Law, LLP

(57) ABSTRACT

An LED luminaire (10) comprising: a main body portion (12) adapted, in use, to house an LED light panel (24); a mount (14) for securing, in use, the luminaire (10) to a surface; a driver unit (62); and a hinge (16, 42, 44) adapted to hingedly connect the main body portion (12) to the mount (14), wherein the hinge (16, 42, 44) comprises a, hollow interior volume for accommodating the driver unit (62), and wherein the driver unit (62) comprises a water-resistant housing.

19 Claims, 6 Drawing Sheets

(51) Int. Cl.

| | |
|---|---|
| ***F21S 8/04*** | (2006.01) |
| ***F21V 21/03*** | (2006.01) |
| ***F21V 21/30*** | (2006.01) |
| ***F21V 23/00*** | (2015.01) |
| ***F21V 17/14*** | (2006.01) |
| *F21V 21/02* | (2006.01) |
| *F21Y 105/10* | (2016.01) |
| *F21Y 115/10* | (2016.01) |
| *F21V 29/503* | (2015.01) |
| *F21W 131/10* | (2006.01) |

(52) U.S. Cl.
CPC ..... *F21V 21/03* (2013.01); *F21V 21/30* (2013.01); *F21V 23/009* (2013.01); *F21S 8/032* (2013.01); *F21S 8/036* (2013.01); *F21V 21/02* (2013.01); *F21V 29/503* (2015.01); *F21W 2131/10* (2013.01); *F21Y 2105/10* (2016.08); *F21Y 2115/10* (2016.08)

(58) Field of Classification Search
CPC ..... F21V 21/03; F21V 21/30; F21V 23/009; F21V 29/503; F21V 31/005; F21W 2131/10; F21Y 2105/10; F21Y 2115/10
See application file for complete search history.

(56) References Cited

OTHER PUBLICATIONS

International Search Report dated May 29, 2015, in parent PCT Application PCT/GB2015/050754.
Search report on GB Patent Application GB1404632.0 dated Apr. 30, 2014.

* cited by examiner

LUMINAIRES

CROSS REFERENCE TO RELATED APPLICATION

The present application is the U.S. national stage application of International Application PCT/GB2015/050754, filed Mar. 16, 2015, which international application was published on Sep. 17, 2015 as International Publication WO 2015/136313 A1. The International Application claims priority of Great Britain Patent Application 1404632.0, filed Mar. 14, 2014.

FIELD OF THE INVENTION

This invention relates to luminaires, and in particular, but without limitation, to LED luminaires suitable for use outdoors.

BACKGROUND

LED luminaires are becoming an increasingly popular choice for lighting installations due to their favourable power consumption, longevity and light quality properties, compared with conventional incandescent, cold cathode and gas discharge lighting systems of equivalent specifications. Unlike, for example, incandescent bulbs, which can operate directly from an AC mains power supply, most LEDs require a relatively low-voltage, DC power source. Moreover, because the longevity of LEDs is closely related to the power (voltage and/or current) supplied to the LEDs over time, careful consideration needs to be given to powering LED lighting systems.

It is therefore commonplace for LED luminaires to comprise a light panel, comprising one or more LEDs (connected together in series, parallel, or a combination thereof) and a driver unit that is interposed between an available power supply and the light panel to condition the power to the light panel. In most applications, the driver unit is connected to a switched mains power supply at its input, and to one or more light panels at its output. The driver unit usually comprises a step-down transformer and a rectifier (for stepping-down the mains voltage to a suitable low voltage, and to convert it from AC to DC, respectively), or in certain applications, a more sophisticated inverter is used, which, whilst being generally more expensive than a transformer-rectifier unit, generally offers better control over the output to the light panel, and can improve the quality of the light emitted by the LEDs and/or their longevity.

Given that a driver unit is generally necessary in most LED lighting applications, the end user has two basic choices:

First, a shared driver unit can be used to provide power to a plurality of LED light panels. This option is generally favoured where a number of LED light panels will be relatively closely spaced, and/or where the cabling to the luminaires needs to be "low-voltage" for safety reasons. However, shared driver units result in dual wiring systems being present, i.e. mains wiring to the driver unit, and low voltage wiring between the driver unit and the light panels. Whilst such a system is not uncommon, and in certain cases, desirable, it does increase the likelihood human error when retrofit modifications are made, for example, it is possible to confuse the low-voltage and mains voltage cables.

Second, a dedicated driver unit can be provided for each LED light panel. Such a configuration greatly simplifies installation because only mains wiring is present on site, but incorporating a driver unit into each LED luminaire increases the size and weight of the luminaires, which can make them unattractive. Moreover, because LED light panels have high cooling requirements, it is usually undesirable to co-locate the driver (which generates heat itself) with the LED light panel. Thus, co-locating the driver unit and LED light panel can complicate cooling considerations, especially where passive air cooling is needed. The main commercial drawback, however, of using integrated drivers and LED panels, is that the LED luminaires tend to appear quite "boxy" and unattractive.

One known solution to this problem is provided by the present applicant's FUSION product, upon which the present invention is based. The FUSION product provides a luminaire with separate LED panel and driver housing, which are hingedly connected to one another. The driver unit is located within a hollow interior portion of the hinge and the hinge is IP-rated to withstand the elements. However, it has been found that due to the relative movement of the hinge components, a seal is difficult to achieve and thus the hinge portion is susceptible to filling with rainwater when the unit is used outdoors, or in a submerged installation, meaning that that driver unit can be subject to wet conditions and/or submersion, even when the surrounding environment is dry. Obviously, this can lead to problems over time, such as ingress of water into the driver unit. Moreover, the need for additional sealing of the hinge components can limit the dimensions of the driver, since the driver needs to be accommodated within the hinge. Using an under-sized driver is mostly undesirable because the driver may then need to work at, or beyond, its duty cycle (compared with a larger driver unit). A further problem that is often encountered with known luminaires is that of correctly affixing the luminaire to a surface, such as a wall or ceiling, which operation is often carried out at height, e.g. using a ladder or a "cherry picker". Because the cabling for a luminaire is usually installed during a "first fix" installation, but the luminaires themselves are installed subsequently, during a "second fix" installation, the installer often has to work with relatively short lengths of cable. However, because one of the objectives of second fix installations is to conceal as much of the cabling as possible from view, the cabling enters the luminaire through the mounting, which means that the luminaire hangs from the wall, by its cable, during installation. A need therefore exists for a luminaire mounting system that provides a temporary, or a secondary, connection between the mounting and the luminaire itself, which permits an installer to use both hands, i.e. without having to support the luminaire with one hand; and/or without simply allowing the luminaire to dangle from its cable during installation of the mount.

A need therefore exists for an improved and/or an alternative LED luminaire, which addresses one or more of the above problems.

SUMMARY OF THE INVENTION

According to a first aspect of the invention, there is provided an LED luminaire comprising: an main body portion adapted, in use, to house an LED light panel; a mount for securing, in use, the luminaire to a surface; a driver unit; and a hinge adapted to hingedly connect the main body portion to the mount, wherein the hinge comprises a hollow interior volume for accommodating the driver unit and wherein the driver unit comprises a water-resistant housing.

Suitably, the water-resistant housing is waterproof and/or the driver is IP-rated. Suitably, the driver unit is an IP-rated driver unit.

By locating a waterproof driver unit within the hollow interior volume of the hinge, physical and/or thermal separation of the driver unit and the LED light panel can be achieved. Suitably, such a configuration may enable the sealing and thermal requirements of the LED light panel and the driver unit to be considered independently. This may be useful, where, for example, the LED light panel comprises encapsulated LEDs and circuitry, which require no additional sealing from the environment, but where the driver unit is of a more conventional design, or vice-versa. Additionally or alternatively, by physically separating the driver unit from the LED light panel, the housing can be provided with cooling fins, ribs or other cooling means that are dedicated to cooling the LEDs. Additionally or alternatively, by physically separating the driver unit from the LED light panel, the heat emitted by the LEDs or the LED light panel may not be transferred to the driver unit.

Thus, the invention may open up a range of new design options and/or thermal configurations that are not possible, or available, in a conventional LED luminaire where the LEDs/LED light panel and the driver unit are co-located.

A second aspect of the invention provides a rotatable connection, suitable for connecting a mount to a luminaire, comprising a bayonet-type connector, the bayonet-type connector comprising at least two pairs of axially- and circumferentially-offset lugs adapted to engage, in use, behind a corresponding set of axially offset circumferential ribs, wherein circumferential ribs each comprise cut-outs configured to allow the respective pairs of lugs to pass therethrough, wherein the bayonet-type connection provides a first rotatable connecting position in which a first pair of lugs engage one of the circumferential ribs and a second rotatable connecting position in which two pairs of lugs engage their respective circumferential ribs.

Thus, the invention provides a connection providing first and second, axially offset rotatable connections between the mount and the luminaire.

Suitably, releasable locking means (e.g. a locking screw) is provided for locking the relative rotation of the mount and luminaire at a desired position.

The mount suitably comprises a tubular stub and a corresponding bayonet portion that fit together one inside the other. The stub suitably comprises two or more sets of axially offset lugs, a first set of which is relatively close to the end of the stub, and the other set of which is set back from the end of the stub by a certain distance. Each set of lugs suitably comprises a pair of diametrically opposing lugs, which may all be substantially the same shape and size, The two sets of lugs are suitably also circumferentially offset by a certain angle.

The bayonet portion suitably comprises an annular disc portion having a series to through holes therein through which mounting screws for the luminaire can extend, in use, to affix it to a surface. The bayonet portion suitably comprises a tubular boss which may comprise a set of radially projecting ribs.

A first one of the radially projecting ribs suitably comprises a circumferential rib that projects radially outwardly from the boss, and which has a pair of diametrically opposed cut-outs shaped to allow the lugs to pass therethrough, when correctly aligned.

A second one of the radially projecting ribs suitably comprises a second radially projecting rib, which comprises a circumferential rib that projects radially outwardly from the boss, and which has a second pair of diametrically opposed cut outs shaped to allow the lugs to pass therethrough, when correctly aligned.

The second set of cut-outs are suitably circumferentially offset by an angle equal to the offset angle of the lugs.

The boss may further comprise a set off axial ribs, which may provide rotational end stops for the lugs.

The boss may further comprise a cable cut-out to permit cabling for the luminaire to pass into the boss. Where provided, the cable cut-out suitably extends axially below the lower edge of the stub, when in the second position.

The boss may further comprise a cable channel to permit cabling for the luminaire to pass into the boss.

The main body portion is adapted, in use, to house an LED light panel. The LED light panel suitably comprises a circuit board to which one or more LEDs are electrically affixed. The LED light panel suitably comprises a transparent or translucent lens portion that overlies the LEDs, and which can be used as a primary optic, or a secondary optic, for the LEDs, i.e. to configure the LED's light output in a desired manner. Where the LED light panel comprises a lens portion, the lens portion can be sealingly affixed to the circuit board, for example, by welding, or adhering, it to the circuit board, and/or by mechanically affixing it to the circuit board with a seal interposed therebetween. Such a configuration can render the LED light panel water- and/or weatherproof. Suitably, the LED light panel is "IP-rated" from IPOO to IP68, with IP65 to IP68 being preferred.

Additionally or alternatively, the main body portion may comprise a sealed, hollow interior portion to provide protection from the elements and a transparent window behind which the LEDs or LED light panel is located.

A thermal bridge means is suitably provided between the LEDs and/or the LED light panel and the main body portion to transfer heat (by convention, but preferably conduction) from the LEDs to the main body portion, which in such an embodiment, is suitably manufactured from a thermally conductive material, such as metal (e.g. aluminium, steep, copper, etc.). The thermal bridge means, where provided, may comprise a thermally-conductive insert physically connecting the exterior of the LEDs or LED light panel to the interior main body portion, or in more sophisticated embodiments, the thermal bridge means may comprise one or more heat pipes, a forced-air cooling system and/or a heat exchanger, depending on the thermal requirements of the luminaire.

The main body portion suitably comprises heat sink elements, such as integrally formed ribs, grooves or protrusions to increase the surface area of the exterior of the main body portion, thereby making it more conducive to heat exchange with the surrounding environment (e.g. water or air).

The LEDs or LED light panel are suitably connected to the driver unit by cabling. The cabling, where provided, may comprise conventional cabling (e.g. twin core +/− earth cabling), a ribbon cable or individual cable cores. A seal, such as a cable gland, bead of sealant, bead of adhesive, etc., is suitably provided where any such cabling enters of leaves the sealed hollow interior volume of the hinge.

The mount suitably comprises a flange portion having one or more through holes therein through which holes, mounting screws can extend to affix the mount, and hence the luminaire to a surface, such as a wall, floor or ceiling. The flange portion may be integrally formed with the mount, or it may be detachably affixable thereto, for example, using a bayonet or threaded connection.

The driver unit suitably comprises an inverter, and/or a step-down transformer and/or a rectifier circuit, for converting an available power supply, such as a mains power supply, into a suitably-conditioned DC power source for powering the LED or LEDs or the LED light panel.

The hinge is adapted to hingedly connect the main body portion to the mount and suitably comprises a plurality of, generally cylindrical tube portions. In one embodiment, one cylindrical tube portion is formed integrally with the main body portion and another cylindrical tube portion is formed integrally with the mount. The respective tube portions may be sealingly connected to one another, for example, using an 0-ring seal, a resiliently deformable member, or a sealing strip interposed between abutting, or overlapping, portions of the respective tube portions.

The hinge suitably comprises end caps for closing off the ends of the tube potions, thereby forming an enclosed hollow interior portion for the driver unit to be housed within. The end caps are suitably removable, for example, by the provision of bayonet-type fittings, or screw threads, and a seal is suitably provided, such as an 0-ring seal, to seal the end cap or caps to the tube portions. In another embodiment, the end caps comprise circular discs (or components having a substantially circular outer periphery) that seat against internal flange portions of the tube portions. Again, a seal is suitably provided between the end cap plates and the flange portions to form a seal, in use. The flanges, where provided, are suitably rebated such that the end caps are flush with the ends of the tube portions, when fitted. The discs (or end caps) can be affixed to the tube portions using mechanical fasteners, such as retaining screws or grub screws.

Thus, the invention provides a hollow interior portion of the hinge, which may be a sealed hollow interior portion, for accommodating the driver unit. Such a configuration means that the hinge portion and/or the driver unit can be IP-rated in its own right (for example, both the hinge and the driver unit could be IP-rated, as a double-failsafe measure) because it can be sealingly contained within the hollow, and/or sealed hollow interior portion of the hinge.

Where the hinge portion is sealed from the environment, further advantages may flow therefrom. For example, by sealing the interior of the hinge, and hence the driver unit contained within it, from the environment, the driver unit is not subject to wet or dirty conditions and more space is available to provide convective cooling airflow within the hinge. Additionally or alternatively, the overall dimensions of the hinge can be reduced thereby improving the aesthetic of the luminaire.

BRIEF DESCRIPTION OF THE DRAWINGS

A preferred embodiment of the invention shall now be described, by way of example only, with reference to the accompanying drawings, in which.

DETAILED DESCRIPTION

Figure 1:
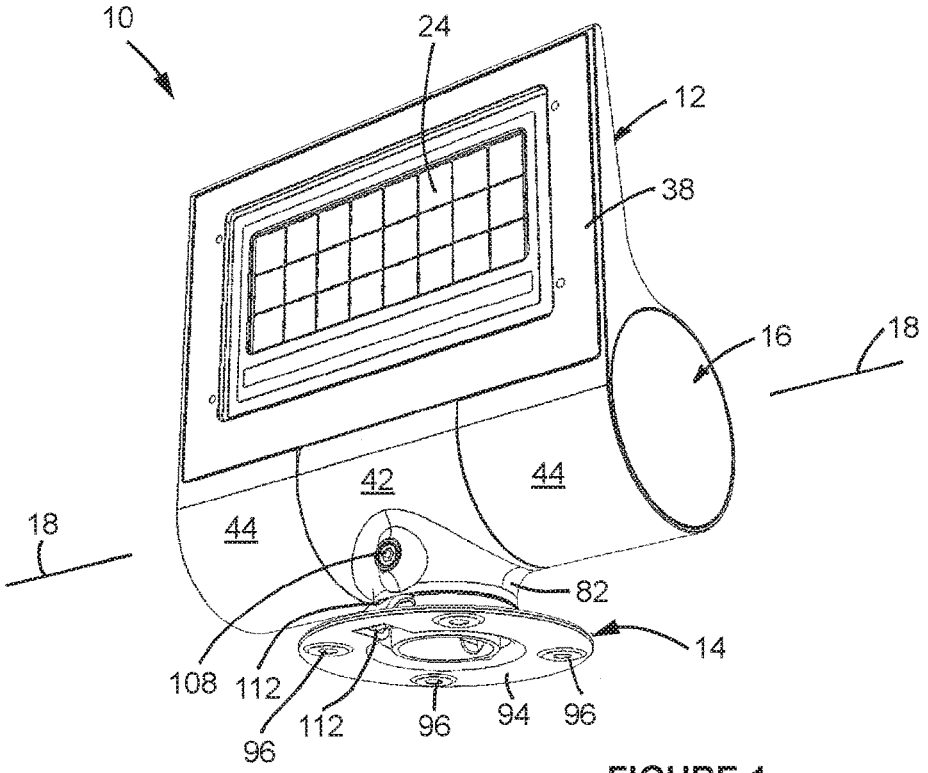
FIG. 1 is a perspective view from the front and below of a luminaire in accordance with the invention.

In FIGS. 1 to 4 of the drawings, a luminaire 10 comprises a main body portion 1 2, a mount 1 4 and a hinge 1 6 interposed between the main body portion 12 and the mount 1 4. The main body portion 12 is able to pivot relative to the mount 14, about the axis 18 of the hinge 16, between first and second positions, as shown particularly in FIGS. 3 and 4.

The main body portion 12 is manufactured from cast aluminium and is provided with a series of integrally formed cooling ribs 20 on a rear surface thereof, which ribs 20 increase the surface area of the main body portion 12 thereby facilitating passive convection of heat away from it, in use.

Figure 6:
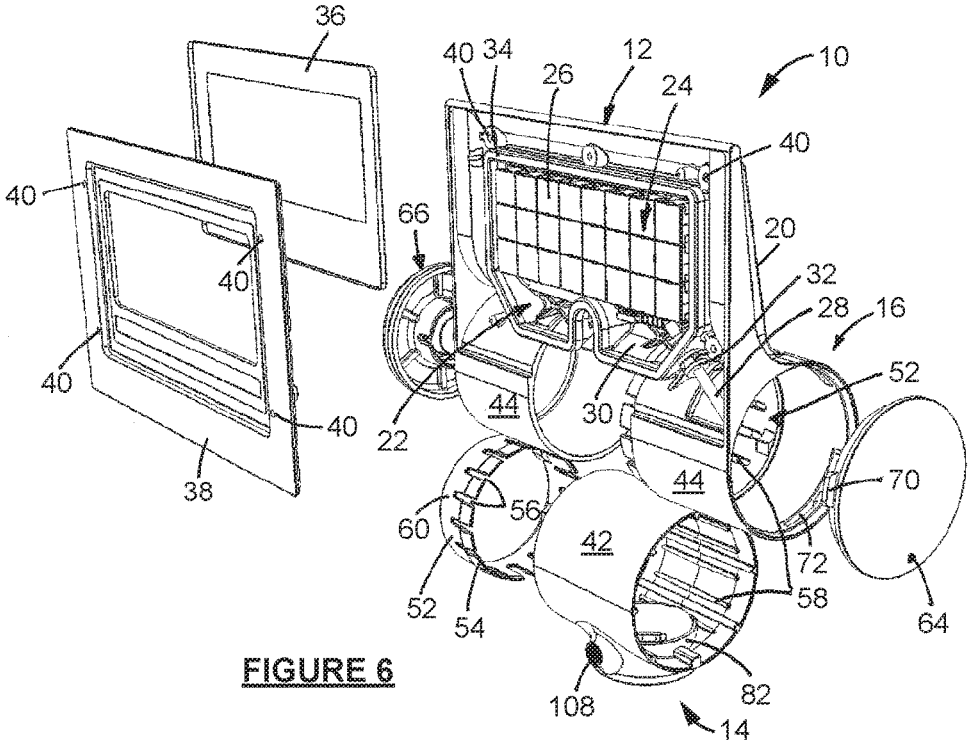
FIG. 6 is a second partial exploded view showing some of the components of the hinge assembly of the luminaire of FIGS. 1 to 4.

As can been seen particularly in FIG. 6 of the drawings, the main body portion 12 comprises an integrally formed cavity 22 into which an LED light panel 24 is installed. The LED light panel comprises (although not shown in the drawings for simplicity), a PCB to which are electrically connected a number of surface-mount LEDs (an 8×3 array of 24 LEDs in the illustrated embodiment, although more or fewer LEDs may be provided), which each comprise an integrally formed lens (a "primary optic") and which sit behind respective individual lens portions ("secondary optics") of a transparent plastics (or glass) cover lens 26. The cover lens 26 seals against the PCB via a bead of adhesive or sealant, thus the LEDs are sealingly encased in the LED light panel between the cover lens 26 and the PCB. A power cable 28 sealingly extends from the LED light panel and passes through a side wall 30 of the cavity 22, via a sealing gland 32.

The peripheral edge of the cavity 22 is provided with a part-circular rebate (not visible) into which seats an O-ring seal or gasket 34. A planar cover plate 36, manufactured from transparent plastics or glass, overlies the cavity 22 and its rear face seats against, and seals with the 0-ring seal or gasket 34 to form a watertight cavity within the main body portion 12 into which the LED light panel is received.

A generally rectangular bezel 38 overlies the cover plate 36 and clamps it in situ via retaining grub screws (not shown) which engage with suitably arranged receiving holes 40 of the bezel 38 and the main body portion 12.

The LED light panel's power cable 28 extends into the hollow interior of the hinge portion 16 of the luminaire, via a gasket plate (not shown for clarity).

Figure 5:
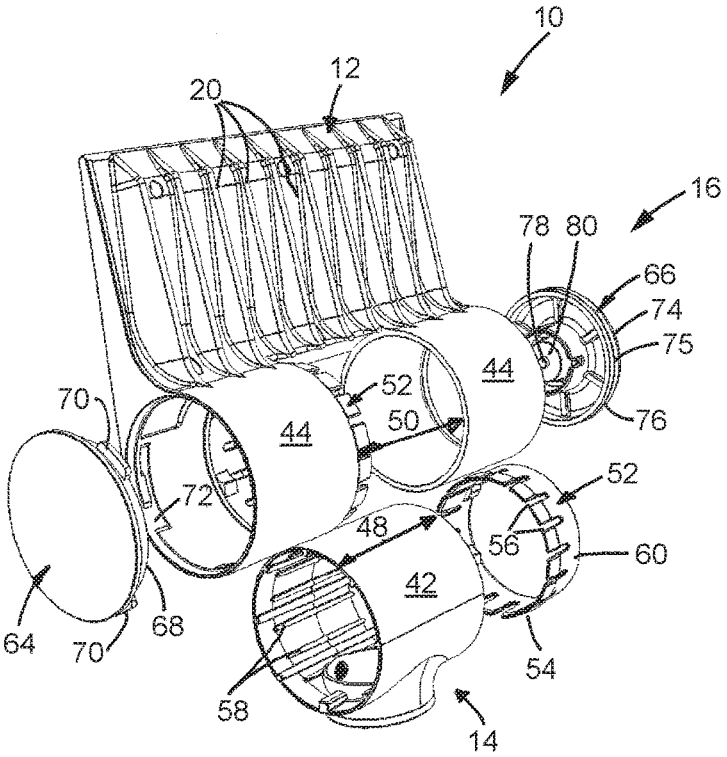
FIG. 5 is a first partial exploded view showing some of the components of the hinge assembly of the luminaire of FIGS. 1 to 4.
Figure 7:
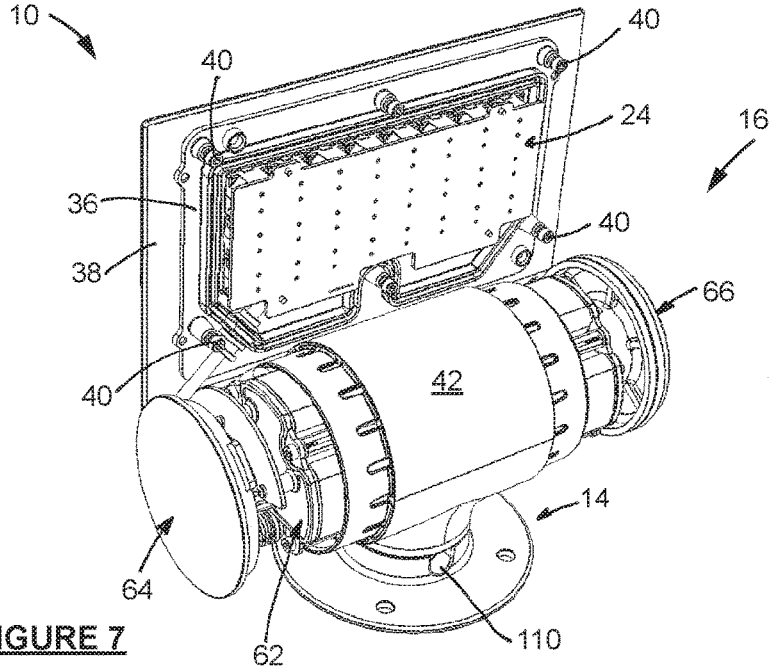
FIG. 7 is a partial perspective view of the luminaire of FIG. 2, showing some of the internal components thereof.

The hinge portion 16, as is best shown in FIGS. 5, 6 and 7 of the drawings, is made up of three main components: a central, generally tubular portion 42, which is integrally formed with the mount 14, and a pair of spaced-apart lateral generally tubular portions 44, which are integrally formed with the main body portion 12 of the luminaire 10. As can be seen from FIGS. 5 and 6 in particular, the width 48 of the central tubular portion 42 is substantially the same as (in fact, slightly smaller than) the lateral spacing 50 between the spaced-apart lateral tube portions 44, such that when the respective components are brought together coaxially, the central tube portion 42 nests neatly between the lateral tube portions 44, for which see FIG. 2.

The central tube portion 42 is connected to the lateral tube portions 44 via a pair of tubular plastics bearings 52. The bearings 52 have a castellated end 54 comprising a series of cut outs 56, which engage with complementarily-shaped ridges 58 formed on the interior side wall of the central portion 42. Thus, as the central portion 42 rotates relative to the lateral portions 44, the bearings 52 rotate in unison with the central portion 42. The bearings 52 additionally comprise a smooth, continuous end portion 60, which provides a contact surface against which the interior side walls of the lateral tube portions 44 seat. Optionally, a bead of layer of sealant or grease, for example, can be applied to the contact surface to form a seal between the bearings 52 and the lateral tube portions 44.

Adhesive is used to sealingly affix the bearings 52 to the central tube portion 42, and a dynamic seal (not shown) is optionally interposed between the continuous end portions 60 of the bearings 52 and the interior side wall of the lateral tube portions 44 to form a seal therebetween. Thus, the hinge 16 provides a tubular cavity for accommodating a driver unit 62 (as shown in FIG. 7), whilst providing a relatively moveable connection between the mount 14 and the main body portion 12 of the luminaire. Further, a sealed arrangement is provided to inhibit and/or prevent the ingress of particulates (e.g. dust, dirt) and liquids (e.g. water) into the hollow interior of the hinge 16.

The ends of the hinge 16 are sealingly closed off at their opposite ends by a semi-permanently connected end plate 64 and by a removable end plate assembly 66. The semi-permanently connected end plate 64 comprises a part-tubular projection 68 carrying a set of radially outwardly extending lugs 70 that engage with complementarily, L-shaped receiving grooves 72 of one of the lateral tube portions 44 of the hinge 16. The semi-permanently connected end plate 64 can be provided with a bead of sealant (not shown) and offered up to the end of the hinge 16, inserted and rotated bayonet-wise, to semi-permanently connect it thereto. As can be seen from FIG. 1, the end plate 64 lies flush with the end of the lateral tube portion 44, thus providing a neat finish.

The removable end plate assembly 66 affixes to the other lateral tube portion 44 of the hinge 16 and comprises a disc-shaped end plate 74 whose peripheral edge 75 seats against a corresponding flange of the lateral tube. An 0-ring seal 76 is provided for sealing the end plate 74 to the interior side wall of the lateral tube portion 44. An axial locking screw 78 is provided as well, which sealingly extends through a cylindrical part 80 of the end plate assembly 66 to engage with a correspondingly positioned, threaded receiving aperture (not visible) of the driver unit 62. Thus, the removable end plate assembly 66 provides two functions: first, it sealingly closes-off the end of the tubular hinge 16 of the luminaire 10; and second, it locates and stabilises the driver unit 62 within the hollow interior of the hinge 16.

The driver unit 62 comprises a waterproof housing, which is suitably IP-rated. The IP-rating of the driver unit 62 is suitably selected to meet the requirements and installation location of the luminaire, for example, submersible (IP6-8), splash-proof (IP6-4) etc.

Figure 8:
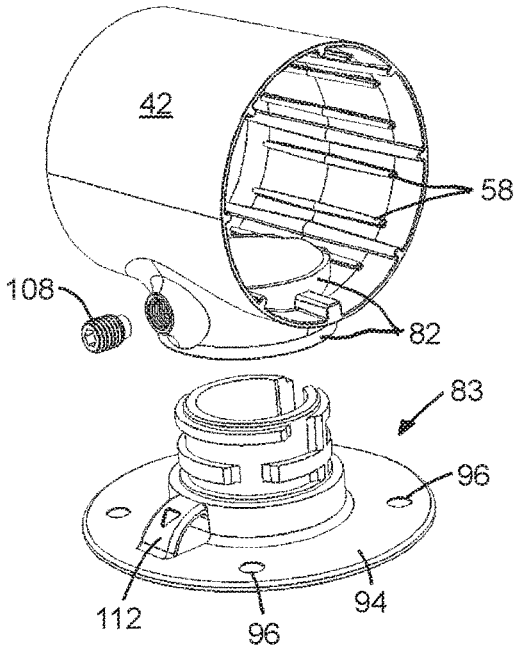
FIGS. 8, 9 and 10 are perspective views from different angles showing the releasable connection mount to the hinge of the luminaire of FIG. 1.
Figure 9:
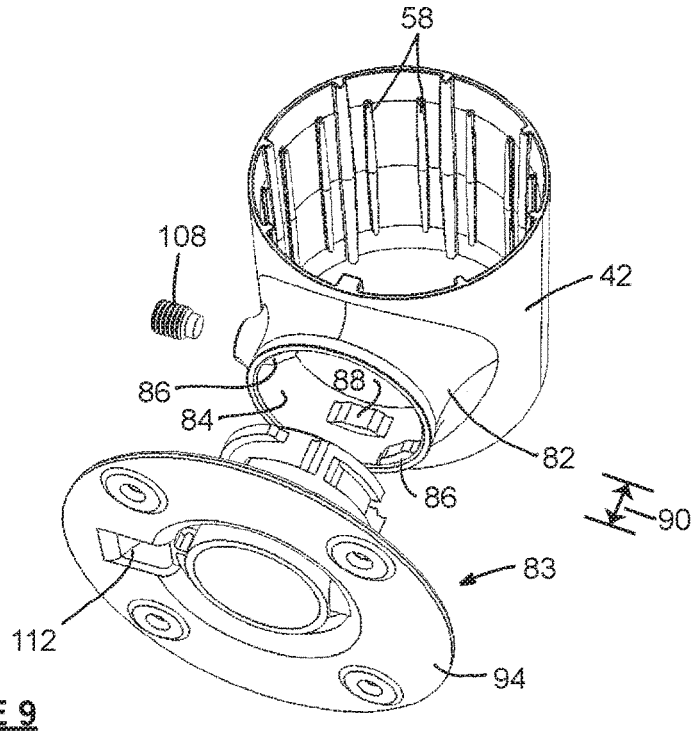
Figure 10:
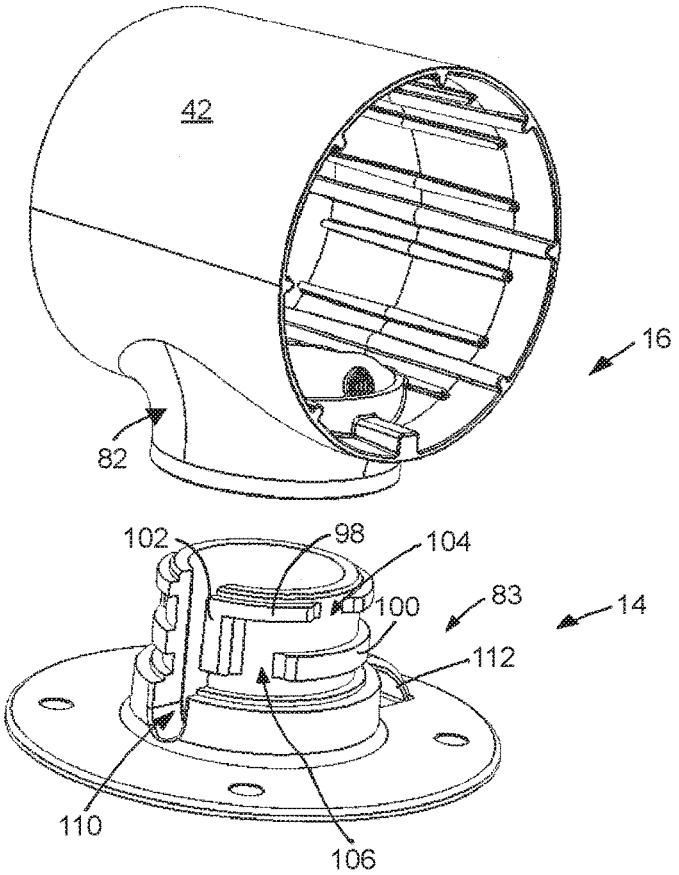

The mount 14 is shown in FIGS. 8, 9 and 10 of the drawings, and is made up of: the central tubular portion 42 of the hinge and an integrally formed, tubular stub 82, which extends radially outwardly from the tubular portion 42; and a bayonet-fitting flange portion 83 that detachably affixes to the stub 82. The stub 82 has an inner side wall 84, which is provided with two sets of axially offset lugs 86, 88, a first set 86 of which is relatively close to the end of the stub 82, and the other set 88 of which is set back from the end of the stub 82 by a distance 90. Each set of lugs 86, 88 comprises a pair of diametrically opposing lugs, which are all substantially the same shape and size, but the two sets of lugs 86, 88 are circumferentially offset by an angle 92, as can be seen in FIGS. 11 to 14 of the drawings.

The bayonet-fitting flange portion 83 comprises an annular disc portion 94 having a series to through holes 96 therein through which mounting screws (not shown) for the luminaire 10 can extend to affix it to a surface (also not shown). Extending axially from the annular disc portion 94 is a tubular boss 96 which comprises a set of radially projecting ribs 98, 100, 102 having a configuration described below.

A first radially projecting rib 98 comprises a circumferential rib that projects radially outwardly from the boss 96, and which has a pair of diametrically opposed cut-outs 104 shaped to allow the lugs 86, 88 to pass therethrough, when correctly aligned. Thus, the stub 82 can be offered up to the boss 96 and the first set of lugs 86 aligned with the cut-outs 104 before being pushed axially into engagement therewith. The first set of lugs 86 thus pass through the cut-outs 104, and the subsequent relative rotation of the stub 82 and boss 96 forms a temporary connection between the mount and the luminaire. However, the stub 82 and boss 96 are not "pushed home" at this stage and the luminaire 10 can be rotated relative to the mount 14 to facilitate installation. In other words, the luminaire 10 is loosely, and temporarily connected to the mount 14 by the first set of lugs 86 engaging behind the first radially projecting rib 98.

Figure 11:
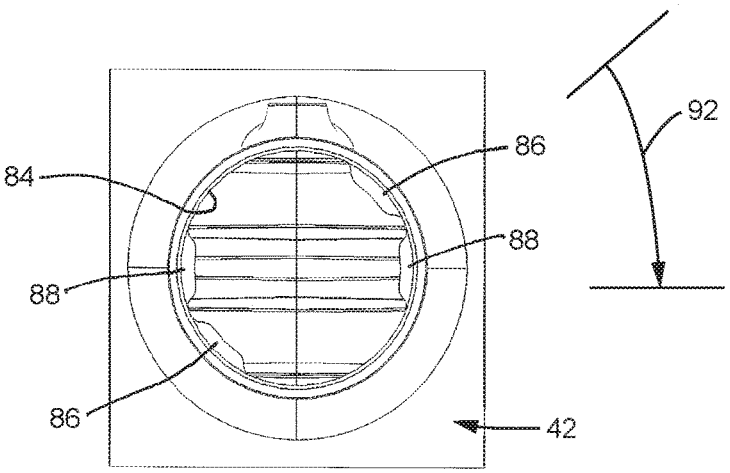
FIG. 11 is a plan view from below of the central tubular portion shown in FIGS. 8, 9 and 10.
Figure 12:
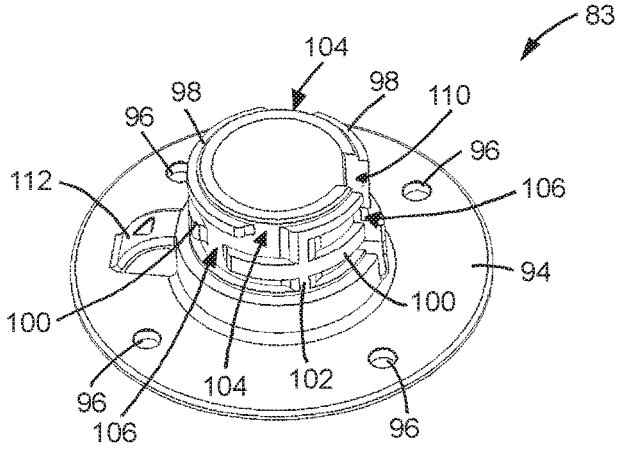
FIGS. 12, 13 and 14 are perspective views from different viewpoints of the bayonet portion of the mount.
Figure 13:
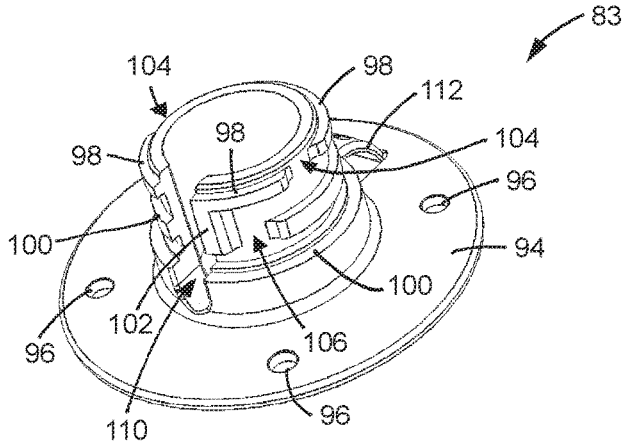
Figure 14:
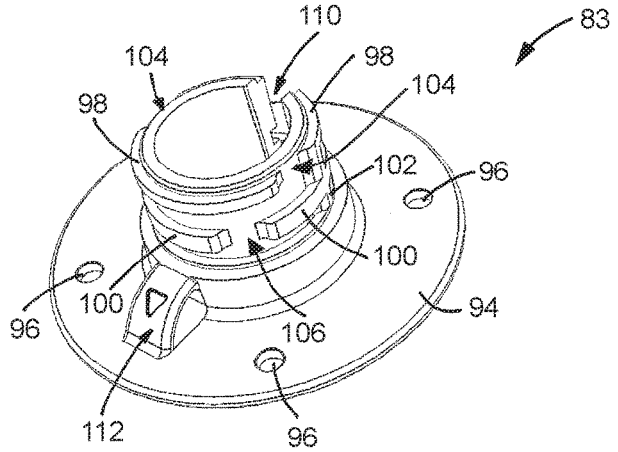

The boss 96 additionally comprises a second radially projecting rib 100, which also comprises a circumferential rib that projects radially outwardly from the boss 96, and which has a second pair of diametrically opposed cut outs 106 shaped to allow the first set of lugs 86 to pass therethrough, when correctly aligned. The second set of cut-outs 106 are circumferentially offset by an angle 92 equal to the offset angle 92 of the lugs (as shown in FIG. 11).

As such, the stub 82 can be moved to a second, installed position by aligning first set of lugs 86 aligned with the second set of cut-outs 106 before pushing the stub 82 axially into engagement therewith yet further. The first set of lugs 86 thus pass through the cut-outs 106, whilst the second set of lugs 88 pass through the first set of cut outs 104 and subsequent relative rotation of the stub 82 and boss 96 forms an installed connection between the mount and the luminaire. In the second position, the luminaire 10 can also be rotated relative to the mount 14 so that it can be rotated to a final position with the first set of lugs 86 engaging behind the second radially projecting rib 100, and the second set of lugs 88 engaging behind the first radially projecting rib 98.

The installation can be locked by tightening a locking screw 108, which forms a releasable mechanical connection between the stub 82 and the boss 96.

Figure 2:
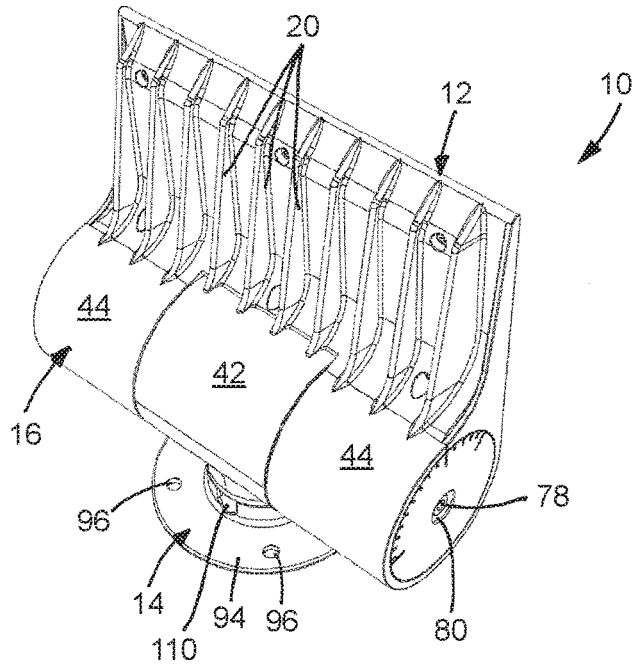
FIG. 2 is a perspective view from the rear and above of the luminaire shown in FIG. 1.
Figure 3:
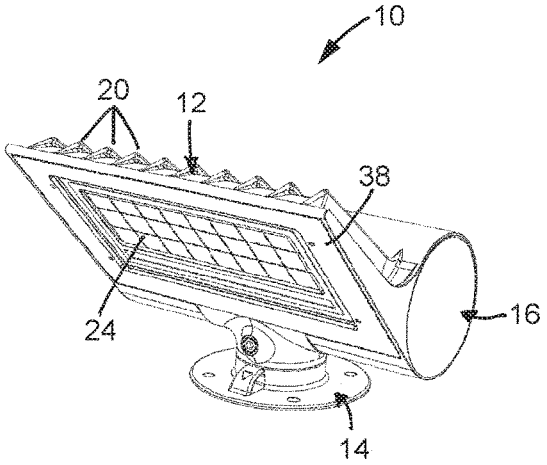
FIG. 3 is a perspective view from the front and above of the luminaire of FIGS. 1 and 2 with the main body portion in a tilted partially forward position.
Figure 4:
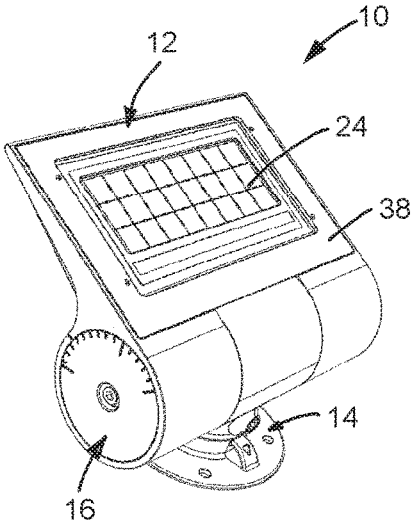
FIG. 4 is a perspective view from the front and above of the luminaire of FIGS. 1, 2 and 3 with the main body portion in a tilted partially rearward position.

It will be noted that the boss 96 additionally comprises a set off axial ribs 102 that provide rotational end stops for the lugs 86, 88, thereby limiting the extent of rotation of the luminaire 10 relative to the mount 14; and a cable cut-out 110 to permit the (mains) cabling for the luminaire 10 to pass into the boss 96. The cable cut-out 110 extends axially below the lower edge of the stub 82, when in the second position, as can be seen in FIG. 2, in particular.

A cable channel 112 is also provided, in the illustrated embodiment, to enable a cable (not shown) to pass from the interior of the mount 14 into a mounting surface (not shown) in a concealed manner.

The invention is not restricted to the details of the foregoing embodiment, which is merely exemplary of the invention. For example, the shape and configuration of the various components thereof, the materials and methods of manufacture etc. could be changed without departing from the scope of the invention.

The invention claimed is:

1. An LED luminaire comprising: an main body portion adapted, in use, to house an LED light panel; a mount for securing, in use, the luminaire to a surface; a driver unit; and a hinge adapted to hingedly connect the main body portion to the mount, wherein the hinge comprises a, hollow interior volume for accommodating the driver unit, and wherein the driver unit comprises a water-resistant housing.

2. The LED luminaire of claim 1, wherein the water-resistant housing comprises a waterproof housing.

3. The LED luminaire of claim 1, wherein the driver unit is IP-rated, and the LED light panel is IP-rated to between IP65 and IP68.

4. The LED luminaire of claim 1, wherein the LED light panel comprises a circuit board to which one or more LEDs are electrically affixed, a transparent or translucent lens portion, sealingly affixed to the circuit board, and overlying the LEDs.

5. The LED luminaire of claim 1, wherein the main body portion comprises a sealed, hollow interior portion adapted to accommodate the LED light panel and a transparent window covering the hollow interior portion behind which window the LED light panel is located.

6. The LED luminaire of claim 1, further comprising a thermal bridge means interposed between the LED light panel and the main body portion, the thermal bridge means comprising any one or more of the group comprising: a thermally conductive insert physically connecting the exterior of the LED light panel to the interior of the main body portion; one or more heat pipes; a forced-air cooling system; and a heat exchanger, wherein the main body portion also comprises heat sink elements in the form of ribs, grooves or protrusions for increasing the surface area of the exterior of the main body portion.

7. The LED luminaire of claim 1, wherein the LED light panel is operatively connected to the driver unit by cabling, and the LED luminaire further comprises a seal where the cabling enters of leaves the hollow interior volume of the hinge.

8. The LED luminaire of claim 1, wherein the hinge comprises a plurality of generally cylindrical tube portions, wherein a first cylindrical tube portion is formed integrally with the main body portion and a second cylindrical tube portion is formed integrally with the mount.

9. The LED luminaire of claim 8, wherein the hinge comprises a central, generally tubular portion integrally formed with the mount, and a pair of spaced-apart lateral generally tubular portions, which are integrally formed with the main body portion of the luminaire, wherein the width of the central tubular portion is substantially equal to the lateral spacing between the spaced-apart lateral tube portions.

10. The LED luminaire of claim 8, wherein the tube portions are sealingly connected to one another.

11. The LED luminaire of claim 9, wherein central tube portion is connected to the lateral tube portions via a pair of tubular bearings, wherein the bearings comprise a castellated end comprising a series of cut outs, which engage, in use, with complementarily-shaped axial ridges formed on an interior side wall of the central tubular portion.

12. The LED luminaire of claim 11, wherein the bearings additionally comprise a smooth, continuous end portion, which provides a sealing surface against which, in use, an interior side wall of the lateral tube portions seat, and the LED luminaire further comprises a dynamic seal interposed between the continuous end portions of the bearings and the interior side wall of the lateral tube portions.

13. The LED luminaire of claim 1 wherein the hinge comprises end caps and, wherein a semi-permanently connected end cap comprises an end plate, a part-tubular projection carrying a set of radially outwardly extending lugs adapted, in use, to engage with complementarily-shaped receiving grooves of one of the lateral tube portions of the hinge, and a seal.

14. The LED luminaire of claim 1, wherein the hinge comprises removable end caps and a removable end cap comprises an end plate assembly comprising a disc-shaped end plate whose peripheral edge is adapted to seat against a corresponding flange of the lateral tube, an 0-ring seal for sealing the end plate to the interior side wall of the lateral tube portion, and an axial locking screw.

15. The LED luminaire of claim 1, comprising a rotatable connection, suitable for connecting a mount to a luminaire, comprising a bayonet-type connector, the bayonet-type connector comprising at least two pairs of axially- and circumferentially-offset lugs adapted to engage, in use, behind a corresponding set of axially offset circumferential ribs, wherein circumferential ribs each comprise cut- outs configured to allow the respective pairs of lugs to pass therethrough, wherein the bayonet-type connection provides a first rotatable connecting position in which a first pair of lugs engage one of the circumferential ribs and a second rotatable connecting position in which two pairs of lugs engage their respective circumferential ribs.

16. The LED luminaire of claim 15, further comprising releasable locking means for locking the relative rotation of the mount and luminaire at a desired position, wherein the mount comprises a tubular stub and a corresponding bayonet portion that fit together one inside the other, and wherein the stub comprises two or more sets of axially offset lugs, a first set of which is relatively close to the end of the stub, and the other set of which is set back from the end of the stub by a certain distance.

17. The LED luminaire of claim 16, wherein each set of lugs comprises a pair of diametrically opposing lugs of substantially the same shape and size, the two sets of lugs being circumferentially offset by an offset angle.

18. The LED luminaire of claim 16, wherein the bayonet portion comprises a tubular boss comprising a set of radially projecting ribs wherein a first one of the radially projecting ribs comprises a circumferential rib that projects radially outwardly from the boss, and which has a pair of diametrically opposed cut-outs shaped to allow the lugs to pass therethrough, when correctly aligned, and further wherein a second one of the radially projecting ribs suitably comprises a second radially projecting rib, which comprises a circumferential rib that projects radially outwardly from the boss, and which has a second pair of diametrically opposed cut outs shaped to allow the lugs to pass therethrough, when correctly aligned.

19. The LED luminaire of claim 18, wherein each set of lugs comprises a pair of diametrically opposing lugs of substantially the same shape and size, the two sets of lugs being circumferentially offset by an offset angle.

* * * * *